US005381863A

United States Patent [19]

Wehner

[11] Patent Number: 5,381,863

[45] Date of Patent: Jan. 17, 1995

[54] CYCLIC HUFF-N-PUFF WITH IMMISCIBLE INJECTION AND MISCIBLE PRODUCTION STEPS

[75] Inventor: Scott C. Wehner, Midland, Tex.

[73] Assignee: Texaco Inc., White Plains, N.Y.

[21] Appl. No.: 182,256

[22] Filed: Jan. 13, 1994

[51] Int. Cl.[6] ..... E21B 43/18; E21B 43/22; E21B 43/25

[52] U.S. Cl. ..... 166/263; 166/268

[58] Field of Search ..... 166/263, 266, 267, 273, 166/272, 268, 300, 252

[56] References Cited

U.S. PATENT DOCUMENTS

| | | | |
|---|---|---|---|
| 3,480,081 | 11/1969 | Felsenthal et al. | 166/263 |
| 4,217,956 | 8/1980 | Goss et al. | 166/273 X |
| 4,324,291 | 4/1982 | Wong et al. | 166/263 X |
| 4,390,068 | 6/1983 | Patton et al. | 166/267 |
| 4,523,642 | 6/1985 | Venkatesan | 166/272 |
| 4,605,066 | 8/1986 | Djabbarah | 166/274 X |
| 4,800,957 | 1/1989 | Stevens, Jr. et al. | 166/268 |
| 4,819,724 | 4/1989 | Bou-Mikael et al. | 166/263 |
| 5,065,821 | 11/1991 | Huang et al. | 166/263 X |
| 5,117,907 | 6/1992 | Hsu | 166/266 |

*Primary Examiner*—Stephen J. Novosad

*Attorney, Agent, or Firm*—James L. Bailey; Kenneth R. Priem; Harold J. Delhommer

[57] ABSTRACT

A method of recovering hydrocarbons from a reservoir under an active waterflood or water drive by injecting a recovery fluid comprising carbon dioxide or nitrogen under immiscible conditions, allowing the recovery fluid to soak, and producing the recovery fluid and formation fluids under conditionally miscible or miscible conditions after pressure has sufficiently increased in the wellbore area.

5 Claims, No Drawings

CYCLIC HUFF-N-PUFF WITH IMMISCIBLE INJECTION AND MISCIBLE PRODUCTION STEPS

BACKGROUND OF THE INVENTION

This invention relates to the recovery of hydrocarbons from an underground reservoir by cyclic injection and production of a recovery fluid comprising carbon dioxide or nitrogen, wherein the formation is subject to an active waterflood or water drive.

Numerous methods of enhanced oil recovery exist which involve the injection of a gaseous or a gaseous/-liquid fluid into an underground formation. Recovery is often best where the fluid is injected at conditions so as to make the fluid miscible or conditionally miscible with the underground hydrocarbons. For non-thermal systems, the chief recovery fluid has been carbon dioxide.

Gaseous or gaseous/liquid recovery fluid methods may be divided into two types: drive processes and cyclic processes, which are also known as huff-n-puff or push/pull. In drive oil recovery processes, injection and production of fluids occur at different wells. In cyclic oil recovery processes, injection and production of fluids occur through the same well. Besides those structural differences, drive and cyclic processes are substantially different in that slugs of recovery fluid are designed differently, times of recovery are different, well patterns are different, costs are different, fluid velocities are different, and so forth.

Unlike drive recovery methods, cyclic processes are better suited for small oil reservoirs, particularly with the use of existing wells. The cost of recovery with a drive process in some smaller reservoirs, especially in deeper zones, may be so high as to make the reservoirs border-line candidates at best for oil recovery after primary or secondary recovery.

One of the earliest disclosures of a cyclic oil recovery process was in U.S. Pat. No. 3,480,081, wherein the flooding medium was water, brine or steam. The success of steam cyclic recovery processes inevitably lead to the cyclic injection and production of carbon dioxide with a soaking. U.S. Pat. No. 4,390,068 discloses such a carbon dioxide cyclic process. Cyclic carbon dioxide recovery has now become a commonplace event in the oil field.

Attempts to recover heavy oils and hydrocarbons from tar sands have lead to a number of processes involving the injection of various solvents and hot fluids in "pressurization and drawdown" methods. These are similar to cyclic carbon dioxide methods in that various solvents and fluids are injected into the formation through a well to increase formation pressure. The fluids may or may not be allowed to soak in the formation prior to producing the injected fluids along with hydrocarbons through the same well. U.S. Pat. No. 4,324,291 is one example of these processes.

The cyclic or huff-n-puff carbon dioxide process as described and practiced in the prior art is a immiscible process due to the reservoir conditions in which it is applied and because it is considered undesirable to push the hydrocarbons further away from the well on which the cyclic process is being applied. The process invariably is applied to pressure depleted reservoirs as a tertiary recovery step after the reservoir has been waterflooded out. These are pressure depleted reservoirs.

The typical cyclic carbon dioxide application relies on the injection of carbon dioxide in an immiscible condition to the hydrocarbons. Injection displaces a large proportion of the water phase within the wellbore vicinity, while bypassing the residual oil-in-place. Although the carbon dioxide absorbs into both the oil and remaining water, absorption into oil is a much slower process than absorption into water. For this reason the well is shut-in for what is termed a soak period. During the soak period, the oil will experience swelling, viscosity and interfacial tension reduction, and an increase in its relative mobility. When the well is returned to production, a portion of the mobilized oil is swept to the wellbore and produced. The prior art has considered it undesirable to perform a cyclic carbon dioxide process under miscible conditions since injection would push the hydrocarbons farther away from the wellbore, and render the hydrocarbons less likely to be recovered during the production phase.

SUMMARY OF THE INVENTION

The invention is a method of recovering hydrocarbons from an underground reservoir under an active waterflood or water drive with a cyclic injection/production process which comprises injecting a recovery fluid comprising carbon dioxide or nitrogen under immiscible conditions and producing the recovery fluid, hydrocarbons and other reservoir fluids under conditionally miscible or miscible conditions.

More specifically, the recovery fluid comprising carbon dioxide or nitrogen is injected into a formation under an active waterflood or water drive through a well, with injection occurring under production conditions wherein the recovery fluid is immiscible with the underground hydrocarbons. Injection of the fluid is then ceased and the fluid is allowed to soak in the formation for a period of about two to about 50 days until the pressure rises in the wellbore area to create conditionally miscible or miscible conditions between the recovery fluid and the underground hydrocarbons. After the soak period, the recovery fluid, which is now conditionally miscible or miscible with the hydrocarbons, is produced along with the hydrocarbons through the well. Injection, soaking, and producing steps can be repeated as desired.

Although the recovery fluid comprises carbon dioxide or nitrogen, carbon dioxide will usually be the fluid of choice. Because substantially higher pressures are required to reach miscible or near miscible conditions for nitrogen than for carbon dioxide, there will be significantly fewer candidate reservoirs for nitrogen than for carbon dioxide recovery fluids. In general, reservoir depth will have to be greater than 8000 feet for nitrogen to be the predominant recovery fluid. Consequently, carbon dioxide is the preferred fluid. Although the text may talk about carbon dioxide, it must be remembered that nitrogen may also be used as the recovery fluid.

DETAILED DESCRIPTION

In cyclic injection recovery, the low density and viscosity of the injected recovery fluid relative to the in-place fluids frequently leads to gas fingering and override, causing the injected recovery fluid to bypass large volumes of oil. Although this may be desirable in the injection phase, it is disadvantageous in the production phase, resulting in the production of excess gas and insufficient oil. Once gas breakthrough occurs during production, the gas/oil ratio becomes excessive and oil recovery declines dramatically. The reservoir energy invested in the injection or huff cycle is no longer sitting behind the oil in the late part of the production or puff cycle, pushing oil towards the producer.

The invention cyclic process takes advantage of the desirability of employing conditionally miscible or miscible movement of carbon dioxide or nitrogen through the reservoir. It has been discovered that such miscible production can be obtained with a more desirable and different immiscible injection step if the cyclic procedure is performed in a reservoir under an active waterflood or water drive. This is a reservoir having opposite characteristics to those reservoirs typically subjected to cyclic carbon dioxide processes.

The invention contemplates taking advantage of relatively low pressure drawdown areas around production wells in such active non-pressure depleted formations. It is possible to inject into a zone which is pressure depleted because of recent production, shut in the well for a sufficient soaking time for the reservoir pressure to rise in the vicinity of that well to a level wherein the injected carbon dioxide or nitrogen is at least conditionally miscible or miscible with the hydrocarbons. Thus, production will take place under the desirable conditions of miscibility or conditional miscibility.

Consequently, the present invention is limited to practice in a relatively high pressure reservoir having an active waterflood or water drive. The initial injection of recovery fluid comprising carbon dioxide or nitrogen occurs under pressure and temperature conditions wherein the recovery fluid is immiscible with the underground hydrocarbons. A sufficient soaking period of about 2 to about 50 days, more preferably 7 to about 30 days, should be tailored to the amount of time needed for the reservoir pressure in that wellbore area to rise sufficiently to create conditionally miscible or miscible conditions between the recovery fluid and the reservoir hydrocarbons. Once this happens, the now conditionally miscible or miscible carbon dioxide, hydrocarbons, and other fluids are produced through the well in such a manner to take advantage of the near wellbore miscible conditions.

In cyclic processes other than steam, the recovery fluid of choice is carbon dioxide. Fluids may be employed in admixture with the carbon dioxide or nitrogen, such as sulfur dioxide, and low molecular weight hydrocarbons such as methane, ethane, propane, butane, pentane, LPG, and mixtures thereof. In fact, during recovery and recycle of produced carbon dioxide or nitrogen for reinjection, there will be quantities of low molecular weight hydrocarbons which may not be economical to remove from the recovery fluid prior to reinjection. The low molecular weight hydrocarbons will usually result in an increase in miscibility of the recovery fluid. Depending upon temperature and pressure considerations, it may be desirable to add low molecular weight hydrocarbons to the initial carbon dioxide or nitrogen injection. Although carbon dioxide and nitrogen are mentioned herein as the recovery fluids, it should be understood that other recovery fluids may be employed in the invention method in steps in conjunction with carbon dioxide or nitrogen, although they will be the predominant constituent of the recovery fluid.

An additional difference over drive processes lies in the fact that it is preferred to conduct the injection phase of a cyclic process at an injection rate high enough to drive the recovery fluid through the formation at a velocity greater than critical velocity so that less hydrocarbons are driven away from the well. Since velocity greater than critical velocity promotes fingering and conformance problems, velocities greater than critical velocity are highly undesirable in hydrocarbon drive processes. For a discussion of critical velocity, please see U.S. Pat. Nos. 3,811,503; 3,878,892; 4,136,738; 4,299,286; 4,418,753; and 4,434,852, the disclosures of which are incorporated herein by reference.

However, in cyclic processes it is frequently desirable to promote fingering during the injection phase, as the radius of reservoir volume invaded by the carbon dioxide is increased, allowing more residual oil to be contacted by the carbon dioxide during the soak period. In general, experience has shown us that the target reservoir volume actually invaded by carbon dioxide at high injection rates will be about 3 to about 5 times the actual reservoir volume of carbon dioxide injected. Thus, about 5% to about 15% of injected pore volume at sufficiently high injection rates can invade about 15% to as much as 75% of a targeted reservoir volume.

After a soaking time period of about 2 to about 50 days, preferably about 7 to about 30 days, the shut-in well is reopened for production. It is preferred to control production so that near-wellbore conditionally miscible or miscible conditions are preserved and that the production well not immediately blow down and encourage fingering of the injected recovery fluid through the formation back to the well. It is desired to control the production phase so that velocity of the recovery fluid through the formation is lower during production than during injection.

If desired, multiple push/pull (huff-n-puff) cycles can be applied to the well with various slug sizes until economic limits are reached. In carbon dioxide cyclic practice, up to six or seven cycles have been performed on a single well. Of course, more could be performed if sufficient recovery was achieved in later cycles to justify further injection and production costs. The invention method should reduce the number of cycles needed per well.

Depending upon the number of wells in a field subjected to the invention method, economic limits can be extended by recycling the produced recovery fluid for further injection. This would involve separating the recovery fluid such as carbon dioxide from the produced fluids and reinjecting the separated recovery fluid with or without some produced hydrocarbons. Some quantities of produced hydrocarbons may enhance the ability of the recovery fluid such as carbon dioxide to recover additional hydrocarbons in future cycles.

Many other variations and modifications may be made in the concepts described above by those skilled in the art without departing from the concepts of the present invention. Accordingly, it should be clearly understood that the concepts disclosed in the description are illustrative only and are not intended as limitations on the scope of the invention.

What is claimed is:

1. A method of recovering hydrocarbons from an underground reservoir under an active waterflood or water drive with a cyclic injection/production process which comprises:

injecting a recovery fluid comprising carbon dioxide or nitrogen into a formation under an active waterflood or water drive through a well, said injection occurring under pressure and temperature conditions wherein the recovery fluid is immiscible with underground hydrocarbons;

ceasing injection of the fluid and allowing the fluid to soak in the formation for a period of about 2 to about 50 days until the pressure rises in the wellbore area to create conditionally miscible or miscible conditions; and producing the conditionally miscible or miscible recovery fluid, hydrocarbons and other fluids through said well.

2. The method of claim 1, further comprising repeating the injecting, soaking and producing steps.

3. The method of claim 1, wherein the soak period is about 7 to about 30 days.

4. The method of claim 1, wherein further comprising injecting the fluid at an injection rate sufficient to force the fluid to move through the formation at a velocity greater than critical velocity.

5. A method of recovering hydrocarbons from an underground reservoir under an active waterflood or water drive with a cyclic injection/production process which comprises:

injecting a recovery fluid comprising carbon dioxide into a formation under an active waterflood or water drive through a well, said injection occurring under pressure and temperature conditions wherein the recovery fluid is immiscible with the underground hydrocarbons;

ceasing injection of the fluid and allowing the fluid to soak in the formation for a period of about 7 to about 30 days until the pressure rises in the wellbore area to create conditionally miscible or miscible conditions between the recovery fluid and the underground hydrocarbons;

producing the conditionally miscible or miscible recovery fluid, hydrocarbons and other fluids through said well;

said recovery fluid injected into the formation at an injection rate sufficient to force the recovery fluid to move through the formation at a velocity greater than critical velocity; and repeating the injecting, soaking, and producing steps.

* * * * *